United States Patent [19]

Yates

[11] 4,122,566

[45] Oct. 31, 1978

[54] FOUNDATION UNIT HAVING A POSTURIZED INNER BORDER

[75] Inventor: Chester R. Yates, Carthage, Mo.

[73] Assignee: Steadley Company, Inc., Carthage, Mo.

[21] Appl. No.: 778,002

[22] Filed: Mar. 16, 1977

[51] Int. Cl.[2] ..... A47C 23/04

[52] U.S. Cl. ..... 5/260; 5/248; 5/267

[58] Field of Search ..... 5/246, 248, 256, 257, 5/258, 260, 262, 267, 268–277, 91, 351; 267/91, 97, 105

[56] References Cited

U.S. PATENT DOCUMENTS 2,291,390 7/1942 Krakauer ..... 5/260

*Primary Examiner*—Peter M. Caun
*Attorney, Agent, or Firm*—Lee & Smith

[57] ABSTRACT

A spring foundation unit having one or more pairs of inner border members on the top and bottom surfaces of the unit. In a conventional fashion, the spring unit has a plurality of transverse rows and longitudinal columns of coil springs, and top and bottom perimeter border wires extending along the outer periphery of the unit and attached to outer coil springs of the transverse rows and longitudinal columns. The inner border members have side elements extending parallel to opposed sides of the unit, with one or more spring widths separating the side elements from the perimeter of the unit. Each side element has a free end which is attached to an end section of the perimeter border wire, and a cross-connecting element interconnecting the opposite ends of the opposed side elements of each inner border member. In one embodiment of the invention, the cross-connecting elements of each pair of inner border members are straight and have at least one spring width separating them. In another embodiment of the invention, the cross-connecting elements are bent in the direction of the end section of the perimeter border member to which its interconnected side elements are attached.

10 Claims, 7 Drawing Figures fig.1.
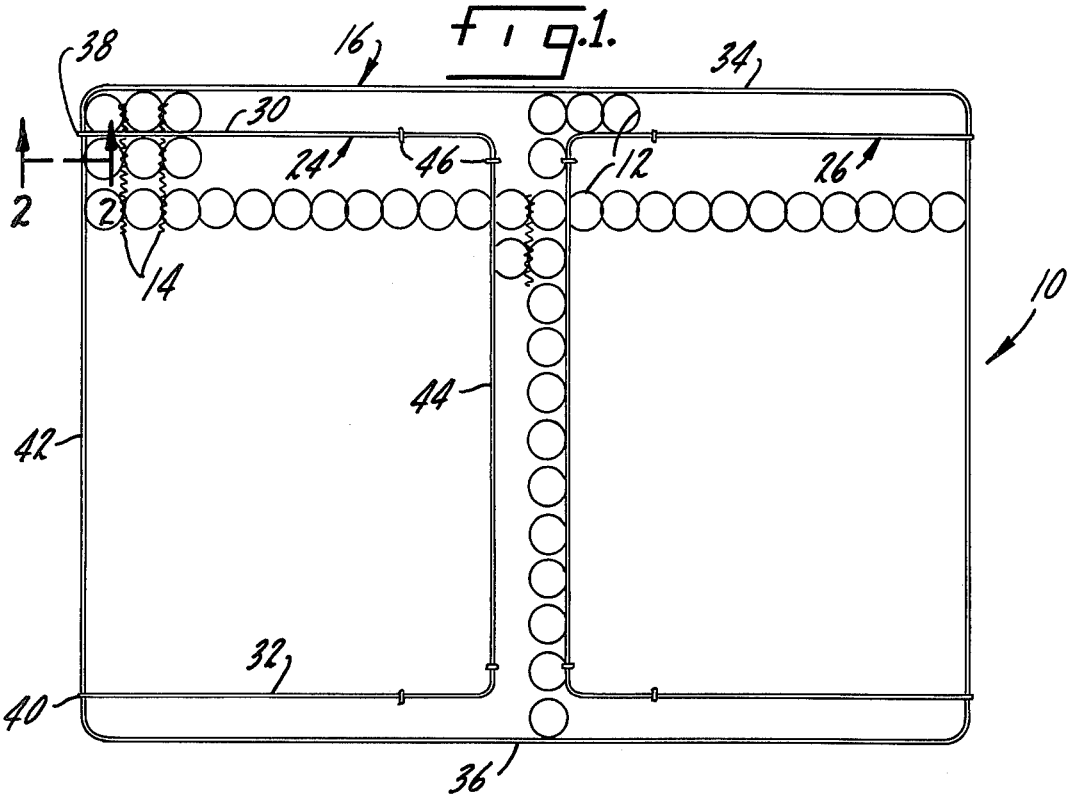
fig.2.
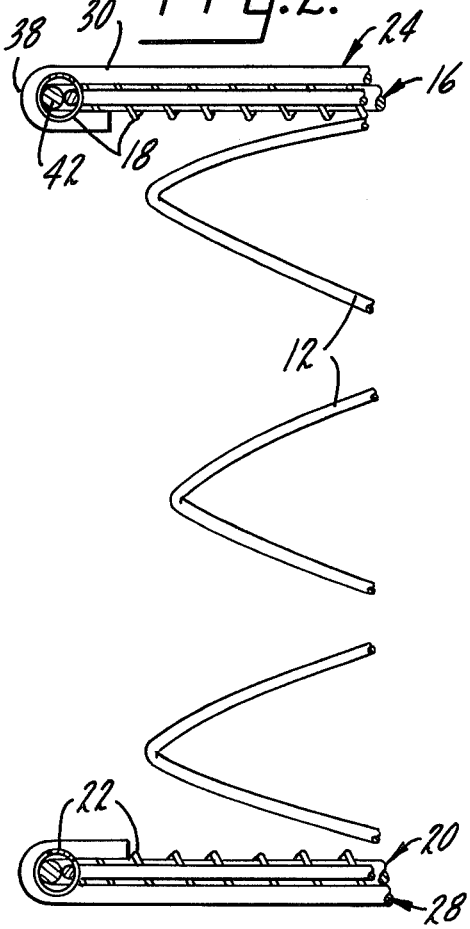
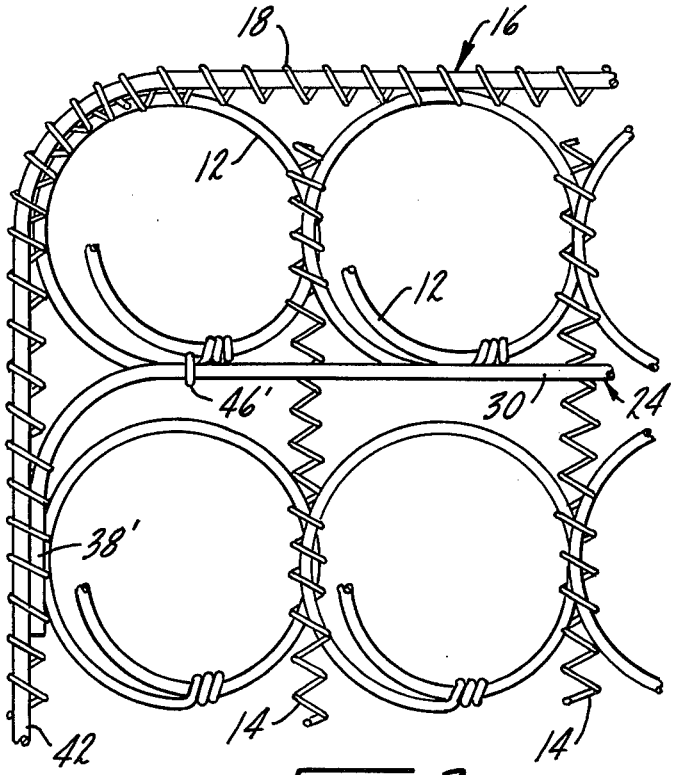
fig.3.

fig. 6.
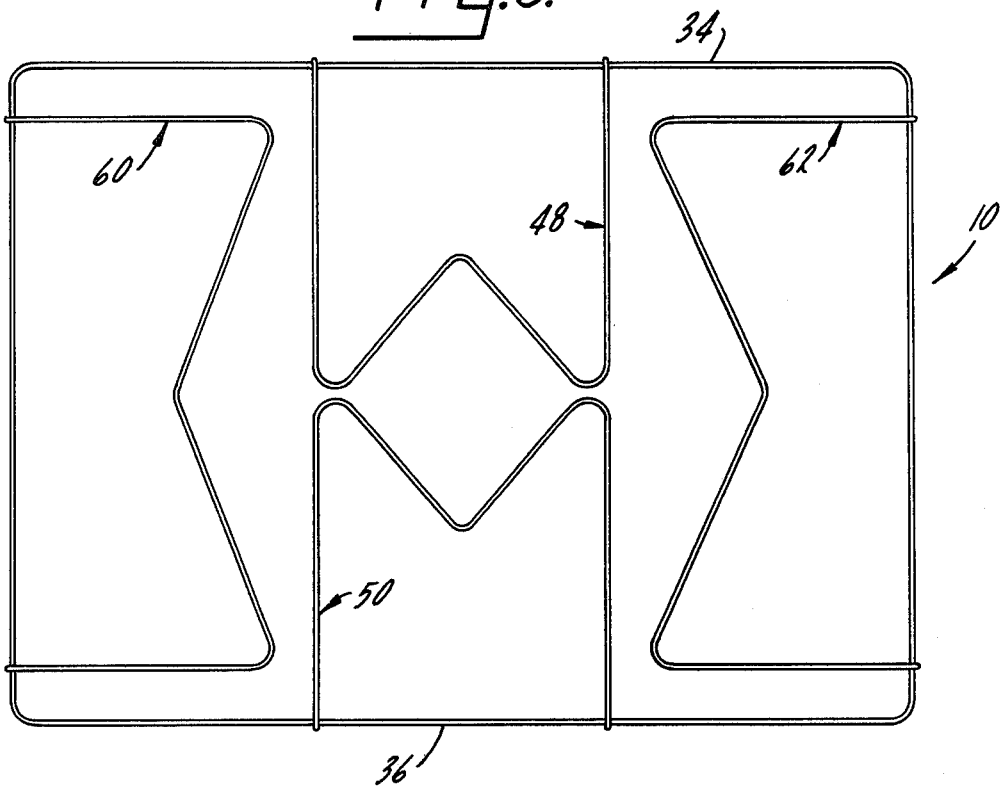
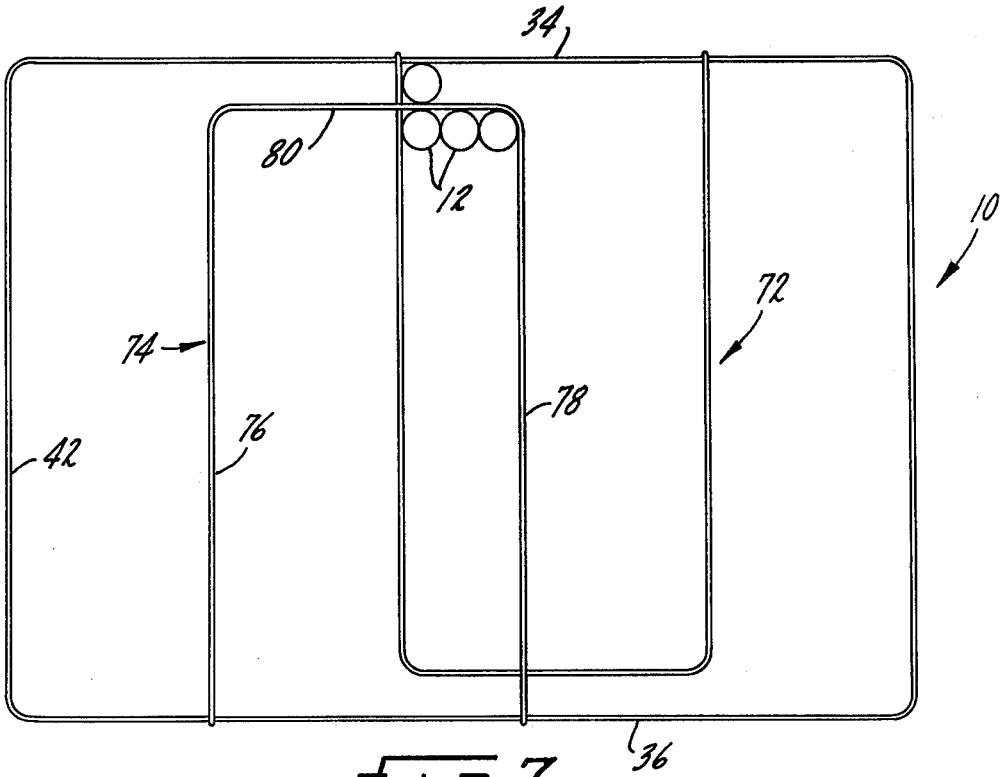
fig. 7.

FOUNDATION UNIT HAVING A POSTURIZED INNER BORDER

SUMMARY OF THE INVENTION

THE BACKGROUND

This invention relates to spring foundation units, and more particularly to a spring foundation unit having one or more pairs of inner border members on the top and bottom surfaces of the unit for increasing the firmness of the foundation unit.

Spring foundation units are well known, as exemplified by U.S. Pat. Nos. 1,237,727 and 2,184,517. Additionally, spring foundation units having one or more inner border members for increasing the firmness of the unit are common, as exemplified by U.S. Pat. Nos. 2,383,157 and 3,242,505.

In the above-identified U.S. Pat. No. 3,242,505, a spring unit is disclosed which has top and bottom inner border members which are separated by at least one width of the coil springs of the unit from the outer border wire of the unit at all times. A plurality of secondary connecting elements extend between opposite end portions of the inner border member. The inner border member and secondary connecting elements are alleged to increase the firmness of the foundation unit.

A substantial disadvantage of prior art apparatus such as U.S. Pat. No. 3,242,505 is that only a certain degree of increased firmness can be attained by utilizing the inner border member and secondary connecting elements because the combined inner border member and connecting elements act as an island of support. In addition, although increased firmness is attained, the stiffer the inner border member and secondary connecting elements become, the less able the foundation unit is to conform to the contours of a user's body. Thus, although the foundation unit is firm, it is also unforgiving and not suitable for providing rigid, yet comfortable support demanded by most consumers.

THE INVENTION

The present invention overcomes the foregoing disabilities of the prior art and others by providing a pair of top and bottom recurvate inner border members for a foundation unit, each having side elements which have free ends joined to a perimeter border member of the foundation unit. The side elements extend parallel to the perimeter border members of the foundation unit, but are spaced by at least the width of one coil spring from the perimeter border members. Each of the inner border members has a cross-connecting element which unites opposed side elements interior of the perimeter border members.

Preferably, the foundation unit according to the invention includes a pair of each of the top and bottom recurvate inner border members. The free end portions of each member of the pairs adjoins a perimeter border member located opposite the perimeter border member adjoining the free end portions of the other member of the pair. Therefore, each member of each pair is a "mirror image" of the other.

The free end portions of the side elements can be joined to a perimeter border wire of the foundation unit in one of two ways. Either the side element is extended and wrapped around an adjacent perimeter border member, or it is curved at its free end so that it is aligned coextensive with its adjacent perimeter border member.

A suitable pigtail or other clip is used to affix the curved free end to the perimeter border member.

In one embodiment of the invention, the cross-connecting elements extending between opposed side elements are straight. At least one spring width separates the cross-connecting elements of each of the top and bottom pairs of inner border members. In another embodiment of the invention, the cross-connecting elements are incurved toward the perimeter border member to which the free end of the side elements are attached.

In an additional embodiment of the invention, the cross-connecting elements extending between opposed side elements are straight, but the side elements are substantially longer than half the distance between opposed sides of the perimeter border member to which they are attached. Therefore, one member of each pair of recurvate inner border members overlies the other member.

In yet another embodiment of the invention, two pairs of each of the top and bottom recurvate inner border members are used. One pair of inner border members of each of the top and bottom recurvate inner border members is located orthogonal to the other pair. Therefore, firmness of the foundation unit is increased even further.

By constructing an apparatus in accordance with the invention, increased firmness of a foundation unit of 20% and more is attained under all operative configurations.

BRIEF DESCRIPTION OF THE DRAWINGS

The invention is depicted in the following drawings in which:

FIG. 1 is a top plan illustration of one embodiment of the invention,

FIG. 2 is an enlarged transverse sectional elevational view of a portion of the unit taken along line 2—2 of FIG. 1, FIG. 3 is an enlarged plan view of a corner portion of the unit of FIG. 1 illustrating an alternative means of connection of the inner border member to a perimeter border member, FIG. 6 is a top plan view of a fourth embodiment of the invention, which is a combination of the second and third embodiments of the invention, and FIG. 7 is a top plan view of a fifth embodiment of the invention, which is an alternative embodiment of the apparatus illustrated in FIG. 1.

DETAILED DESCRIPTION OF THE DRAWINGS

Figure 4:
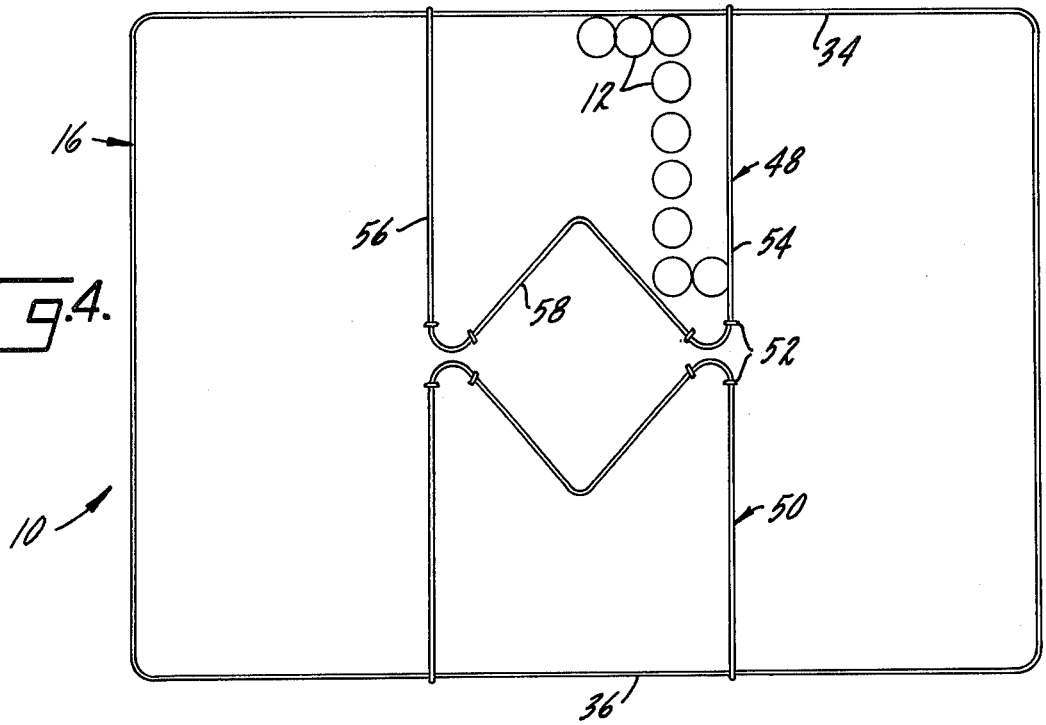
FIG. 4 is a top plan view of a second embodiment of the invention.

A foundation unit according to the invention is generally depicted in the drawings by the reference numeral 10. The unit 10 has a plurality of spaced parallel longitudinal columns and transverse rows of coil springs 12. Longitudinal pigtails 14 interconnect adjacent members of each of the transverse rows of coil springs 12. A top perimeter border member 16 is connected by a pigtail 18 to the outer edges of the coil springs in the terminal longitudinal columns and transverse rows of the coil springs. Similarly, a bottom perimeter border member 20 is connected by a pigtail 22 to the outer edges of the coil springs in the terminal longitudinal columns and transverse rows of coil springs.

As illustrated in FIG. 1, the foundation unit 10 includes a pair of top recurvate inner border members 24 and 26 located on the upper surface of the foundation unit. Although not illustrated, a corresponding pair of bottom recurvate inner border members are located on the bottom surface of the foundation unit. A portion of a bottom recurvate inner border member 28 is illustrated in FIG. 2. The top and bottom recurvate inner border members are identical and each member of each pair of inner border members is identical to the other. Therefore, only the member 24 will be described in detail, it being understood that all other members appear and function in an identical manner.

The top recurvate inner border member 24 has side elements 30 and 32 extending parallel to respective elongated edge sections 34 and 36 of the top perimeter border member 16. As illustrated, one width of coil springs 12 separates the side elements 30 and 32 from the edge sections 34 and 36. Depending on the width of the foundation unit, a smaller distance or an additional transverse row or rows of coil springs 12 can separate the edge sections from the side elements 30 and 32.

Each of the side elements 30 and 32 has respective integral free end portions 38 and 40 attached to an end section 42 of the top perimeter border member 16. As best illustrated in FIG. 2, the free end portion 38 is wrapped in a recurvate fashion about the end section 42. The free end portion 40 is wrapped about the end section 42 in a similar manner.

A cross-connecting element 44 of the top recurvate inner border member 24 unites the opposed side elements 30 and 32 interior of the perimeter border member 16. As illustrated, the cross-connecting element 44 is an integral portion of the top recurvate inner border member 24, although, if desired, the element 44 can be attached to the side elements 30 and 32 rather than an integral part thereof.

A plurality of clips 46 are utilized to attach the inner border member 24 to one or more of the coil springs 12. The number of clips 46 and the placement thereof will dictate the overall firmness of the foundation unit and firmness at particular locations thereof.

It is preferred that one or more longitudinal columns of coil springs 12 separate the cross-connecting elements of the pair of top recurvate inner border members 24 and 26. Two such columns are depicted in FIG. 1. However, if desired, the top recurvate inner border members could overlap. The amount of separation will depend on the size of the foundation unit and degree and location of firmness desired.

FIG. 3 illustrates an alternative means of joining the free end portions of each of the inner border members to the end section 42 of the top perimeter border member 16. Rather than being wrapped around the end section 42 as illustrated in FIG. 2, the free end portion 38′ of the side element 30 is a curved extension thereof lying coextensive with the end section 42. It is attached to the end section 42 by the pigtail 18. An additional clip 46′ is employed to ensure that the free end portion 38′ is retained laterally immobile.

FIG. 4 illustrates an alternative embodiment of the invention for increasing the firmness of the foundation unit 10 only in a central location. In this embodiment, recurvate inner border members 48 and 50 are attached to the side sections 34 and 36 of the top perimeter border member 16. Identical members (not illustrated) are attached to the bottom perimeter border member 20 in the same manner. The two members 48 and 50 are substantially identical. The detailed structure of the recurvate inner border member 48 only will therefore be described, it being understood that member 50 is identical in all respects.

Each of the recurvate inner border members 48 and 50 is attached to one or more of the coil springs 12 by one or more clip members 52. The number of clip members 52 and the number of coil springs 12 to which the members 48 and 50 are attached will dictate the firmness of the foundation unit.

The member 48 has a pair of side elements 54 and 56 attached to the side section 34. A cross-connecting element 58 extends between the opposed side elements. Rather than being straight as the cross-connecting element 44 of the embodiment of FIG. 1, the cross-connecting element 58 is incurved toward the side section 34. Therefore, the member 44 appears as an inverted letter M to the viewer of FIG. 4. The incurving of the cross-connecting element 58 increases the effective area of increased support of the foundation unit 10. Therefore, the foundation unit has increased firmness over a larger supporting surface.

The recurvate inner border members 48 and 50 are illustrated with less than the width of one of the coil springs 12 separating their end connecting elements. Depending on the firmness characteristics desired, one or more coil spring widths can be situated between opposed members. Therefore, the spacing shown is preferred, but not mandatory.

Figure 5:
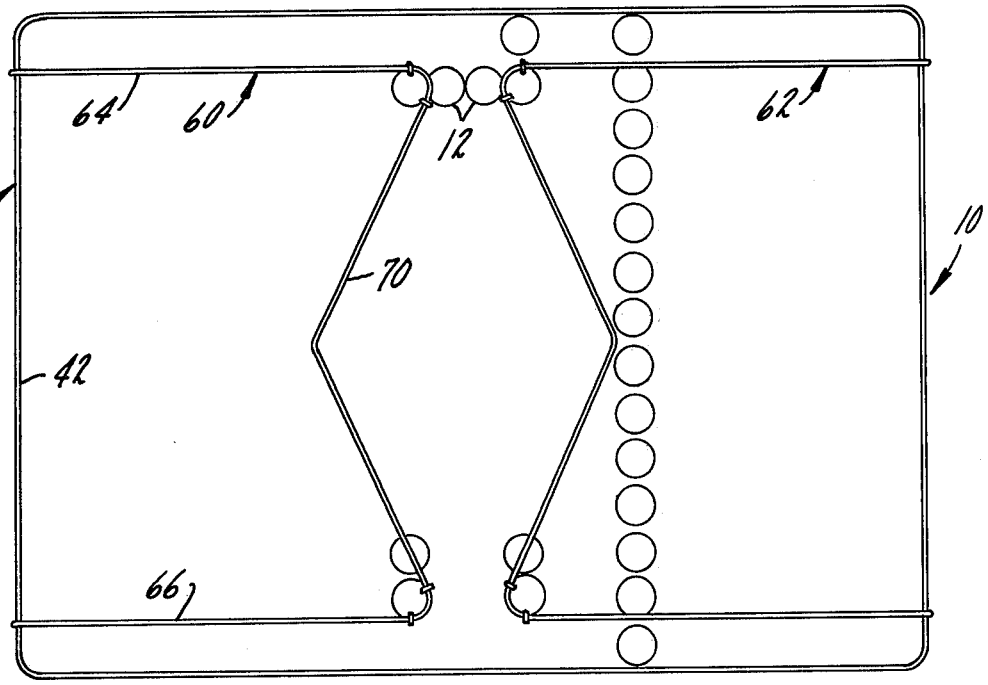
FIG. 5 is a top plan view of a third embodiment of the invention.

In FIG. 5, an alternative placement of the recurvate inner border members of the embodiment of FIG. 4 is illustrated, being substantially similar to the embodiment of FIG. 1. The foundation unit 10 has opposed recurvate inner border members 60 and 62 attached to opposed end sections of the top perimeter border member 16. The members 60 and 62 are identical, and therefore the detailed structure of the member 60 only will be examined.

The recurvate inner border member 60 is composed of a pair of side elements 64 and 66 attached to the end section 42 of the top perimeter border member 16. A cross-connecting element 70 extends between the side elements 64 and 66. As illustrated, the cross-connecting element 70 is incurved toward the end section 42. The degree of incurving, as that of the cross-connecting element 58 of FIG. 4, will depend on the degree of increased firmness desired. It can be seen that the effective area of support of the structure of FIG. 5 is substantially greater than that of FIG. 1 due to the incurved cross-connecting elements of the inner border members 60 and 62.

As FIG. 1, the recurvate inner border members 60 and 62 of the embodiment of FIG. 5 are separated by two widths of the coil springs 12. The particular separation, however, depends on the degree and location of increased firmness desired. Therefore, although the separation of two coil springs widths has been illustrated as a preferred embodiment of the structure, it is not mandatory.

FIG. 6 is fourth alternative embodiment of the invention illustrating a combination of the embodiments of FIGS. 4 and 5. As shown, the recurvate inner border members 48 and 50 extend between the recurvate inner border members 60 and 62. Alternatively, the members 60 and 62 could extend between the members 48 and 50, or one pair of members could overlie the other. Utilizing two pairs of inner border members in the manner illustrated in FIG. 6 results in even greater increased firmness of the foundation unit structure. Furthermore, a greater area of increased firmness results from attaching the members 48 and 50 to the respective edge sections 34 and 36 and attaching the members 60 and 62 to the end sections. The structure as illustrated in FIG. 6 is most preferable when either an extremely firm foundation unit is desired, or when a very large foundation unit is constructed. Spacing between opposed members of the pairs of inner border members and the placement of the inner border members themselves will depend on the support characteristics desired and the location thereof.

FIG. 7 illustrates an alternative embodiment of the apparatus as depicted in FIG. 1. A pair of top recurvate inner border members 72 and 74, attached to respective edge sections 34 and 36, are located on the upper surface of the foundation unit. Although not illustrated, to allow use of either surface of the unit as the upper surface, a corresponding pair of bottom recurvate inner border members would be located on the bottom surface of the foundation unit. since the members 72 and 74 are identical, only the member 74 will be described in detail.

As the inner border members 24 and 26 of the embodiment of FIG. 1, the member 74 has a pair of side elements 76 and 78 and a cross-connecting element 80. The side elements 76 and 78 are substantially longer than half the length of the end section 42, causing the members 72 and 74 to overlap, as illustrated. Either of the members 72 and 74 may overlie the other.

The width of three longitudinal columns of the coil springs 12 is shown separating side elements of the overlapping members 72 and 74. Depending on the size of the coil springs and the desired area of overlap and increased firmness, greater or fewer columns of coil springs may be used to separate the side elements in the overlapping portion. Similarly, the width of one transverse row of coil springs 12 separates the cross-connecting element 80 from the edge section 34. This distance may also be increased or decreased depending on support characteristics desired.

The increased firmness of a foundation unit employing the inner border members of the invention is due to resistance to bending and stretching of the inner border member. When a load is applied to the foundation unit 10, the inner border members deflect as the upper surface of the unit is depressed, pulling against the end sections of the perimeter border member 16 to which the inner border members are attached. Therefore, unlike the prior art, the area of increased firmness is not an island within the confines of the unit.

The "M" configuration of FIGS. 4 through 6 increases firmness over the "H" configuration of FIG. 1 because not only do the inner border members pull against their respective end or edge sections, but also the cross-connecting elements of the inner border members, due to their incurved shapes, act as torsion bar elements. Therefore, as the load on the unit increases, so too does the percentage of added firmness.

Various changes may be made to the invention without departing from the spirit thereof or the scope of the following claims.

I claim:

1. In a spring unit having a plurality of parallel longitudinal columns and transverse rows of coil springs, each row and column being the width of at least one coil spring, and top and bottom perimeter border members connected to the outer edges of the coil springs in the terminal longitudinal columns and transverse rows thereof, the improvement comprising:

top and bottom recurvate inner border members positioned to coact with at least some of the coil springs when depressed for increasing the depth dimensional firmness of the unit, each member having a pair of parallel side elements extending parallel to, but spaced from, the perimeter border members, each having free end portions of said side elements adjoining a single section of an adjacent perimeter border member, and each having a cross-connecting element uniting said side elements interior of, spaced from and unattached to the perimeter border members, and means joining the free end portions of each of said inner border members to the single section of the adjacent perimeter border member.

2. The spring unit according to claim 1 including a pair of each of said top and bottom recurvate inner border members, the free end portions of one member of each of said pairs adjoining a section of a perimeter border member located opposite the section of the perimeter border member adjoining the free end portions of the other member.

3. The spring unit according to claim 2 in which at least one spring width separates the cross-connecting elements of each pair of said recurvate inner border members.

4. The spring unit according to claim 2 in which one member of each of said pairs of recurvate inner border members overlaps the other member of said pair.

5. The spring unit according to claim 1 in which said means joining comprises an extension of said side element wrapped around said adjacent perimeter border member.

6. The spring unit according to claim 1 in which said means joining comprises a curved extension of said side element lying coextensive with and affixed to said adjacent perimeter border member.

7. The spring unit according to claim 1 including two pairs of each of said top and bottom recurvate inner border members, the free end portions of one member of each of said pairs adjoining a section of a perimeter border member located opposite the section of the perimeter border member adjoining the free end portions of the other member.

8. The spring unit according to claim 7 in which one pair of each of said two pairs of recurvate inner border members is located orthogonal to the other pair of recurvate inner border members.

9. The spring unit according to claim 1 in which said cross-connecting element is incurved toward said adjacent perimeter border member.

10. A spring foundation unit comprising:

(a) a plurality of parallel longitudinal columns and transverse rows of coil springs, each row and column being the width of at least one coil spring, (b) top and bottom perimeter border members connected to the outer edges of the coil springs in the terminal longitudinal columns and transverse rows, (c) at least one pair of recurvate inner border members positioned to coact with at least some of the coil springs when depressed for increasing the depth dimensional firmness of the foundation unit, each inner border member having a pair of parallel side elements extending parallel to, but spaced laterally from, the perimeter border members, (d) a first end of each of said side elements comprising a free end portion adjoining a single section of a perimeter border member, (e) an integral cross-connecting element uniting a second end of each of the side elements of each member of said pairs of inner border members, said cross-connecting element being positioned interior of, spaced from and unattached to the perimeter border members, and (f) means to join each of said free end portions to the single section of the adjacent perimeter border member.

* * * * *